US007047594B2

(12) United States Patent
Inoue

(10) Patent No.: US 7,047,594 B2
(45) Date of Patent: May 23, 2006

(54) CYCLONIC VACUUM CLEANER

(75) Inventor: Mineyuki Inoue, Niigata-ken (JP)

(73) Assignee: Twinbird Corporation (JP)

( * ) Notice: Subject to any disclaimer, the term of this patent is extended or adjusted under 35 U.S.C. 154(b) by 394 days.

(21) Appl. No.: 10/370,546

(22) Filed: Feb. 20, 2003

(65) Prior Publication Data

US 2003/0163887 A1 Sep. 4, 2003

(30) Foreign Application Priority Data

Mar. 4, 2002 (JP) ..... 2002-057665

(51) Int. Cl.
*A47L 9/16* (2006.01)

(52) U.S. Cl. ..... 15/353; 15/350

(58) Field of Classification Search ..... 15/327.1, 15/327.2, 327.6, 327.7, 347, 350–353; 55/337, 55/429, 459.1, 482, 486, DIG. 3
See application file for complete search history.

(56) References Cited

U.S. PATENT DOCUMENTS

| | | | | | |
|---|---|---|---|---|---|
| 3,543,325 | A * | 12/1970 | Hamrick | 15/314 |
| 4,172,710 | A * | 10/1979 | van der Molen | 55/340 |
| 4,853,008 | A * | 8/1989 | Dyson | 55/345 |
| 5,145,499 | A * | 9/1992 | Dyson | 55/337 |
| 5,230,722 | A * | 7/1993 | Yonkers | 55/337 |
| 5,950,274 | A * | 9/1999 | Kilstrom | 15/350 |
| 5,971,497 | A * | 10/1999 | Lee | 301/111.05 |
| 6,026,540 | A * | 2/2000 | Wright et al. | 15/347 |
| 6,146,434 | A * | 11/2000 | Scalfani et al. | 55/334 |
| 6,425,931 | B1 * | 7/2002 | Croggon | 55/414 |
| 6,428,589 | B1 * | 8/2002 | Bair et al. | 55/318 |
| 6,558,453 | B1 * | 5/2003 | Sepke et al. | 95/268 |
| 6,757,933 | B1 * | 7/2004 | Oh et al. | 15/353 |
| 6,889,403 | B1 * | 5/2005 | Inoue et al. | 15/353 |
| 2002/0020154 | A1 * | 2/2002 | Yang | 55/337 |

FOREIGN PATENT DOCUMENTS

| | | |
|---|---|---|
| EP | 0 827 710 A2 | 3/1998 |
| EP | 1 157 650 A2 | 11/2001 |
| GB | 2 321 181 A | 7/1998 |
| GB | 2 369 291 A | 5/2002 |
| GB | 2 370 979 A | 7/2002 |
| GB | 2 373 996 A | 10/2002 |
| GB | 2 381 222 A | 4/2003 |
| JP | 2000-166829 | 6/2000 |
| JP | 2001-037687 | 2/2001 |
| JP | 2001-104223 | 4/2001 |
| JP | 2001-104223 A | 4/2001 |
| JP | 2002-051953 A | 2/2002 |

* cited by examiner

*Primary Examiner*—Terrence R. Till
(74) *Attorney, Agent, or Firm*—Akerman Senterfitt

(57) ABSTRACT

A cyclonic vacuum cleaner having a simple structure with low airflow leakage and excellent maintainability despite its long suction passage. A dust-collecting portion 11 includes a cyclonic portion 14 which is approximately cylinder-shaped, having a bottom and an introducing portion 15 for introducing dust-laden airflow to the cyclonic portion 14. The cyclonic portion 14 and the introducing portion 15 are integrally formed and then a vortex flow generating member 21 is provided in the dust-collecting portion 11. Thus, the structure of the dust-collecting portion can be simplified and thus the dusts can be dumped by detaching the dust-collecting portion 11 together with the introducing portion 15. Consequently, maintenance can be easily performed. Further, as the number of joints can be reduced, possibility of airflow leakage within the suction passage is reduced, so that dust-collecting performance can be enhanced.

12 Claims, 14 Drawing Sheets

CYCLONIC VACUUM CLEANER

BACKGROUND OF THE INVENTION

1. Field of the Invention

The present invention relates to a cyclonic vacuum cleaner, specifically to a stick type one.

2. Description of the Related Art

One of conventional cyclonic vacuum cleaners of this type is disclosed in, for example, Japanese Un-Examined patent publication No. 2001-104223. The disclosed vacuum cleaner comprises a cleaner body including a built-in fan motor, a suction passage (an introducing portion) provided in its rear portion and a suction opening (a sucking nozzle) provided in its lower portion, wherein a dust box (a cyclonic portion), having a bottom and an intake hole formed tangentially on a sidewall, is detachably attached to the cleaner body. By actuating the motor fan, a dust-laden air is sucked from the suction opening and then flows through the suction passage and the intake hole to reach the inside of the dust box where it is converted into a vortex flow, so that the dust is separated by a centrifugal force developed inside the dust box.

According to such conventional cyclonic vacuum cleaners, however, as dust-laden air must be introduced from an upper side of the dust box, the suction passage from the suction opening to the dust box would inevitably become lengthy, thus resulting not only in a complex structure of the vacuum cleaner as a whole, but also in the increased number of components that eventually leads to high manufacture costs of the cleaner products obtained, even leading to a likelihood of airflow leakage to occur in joints between such increased components. Further, the dust box is joined to the cleaner body through two joints, i.e., that in an exhaust opening and that in the suction passage of the cleaner body in an airflow passage from the suction opening to the motor fan, thus resulting in a high likelihood to cause airflow leakage. Furthermore, for instance, when film-like or clumpy dusts are sucked, the suction passage may happen to be clogged with such dusts, thus causing a problem of poor maintainability due to a difficulty in removing such dusts caught in the suction passage.

SUMMARY OF THE INVENTION

To eliminate the above-mentioned problems, it is, therefore, an object of the present invention to provide a cyclonic vacuum cleaner which has a simple structure, and causes little airflow leakage despite a long suction passage.

It is another object of the present invention to provide a cyclonic vacuum cleaner which is easy to do maintenance on.

A cyclonic vacuum cleaner according to a first aspect of the invention comprising a cleaner body with a fan motor and a dust-collecting portion detachably attached to the cleaner body, wherein said dust-collecting portion comprises: a cyclonic portion which is approximately cylinder-shaped, having a bottom; an introducing portion for introducing dust-laden airflow into said cyclonic portion, said introducing portion being formed integrally with said cyclonic portion; a vortex flow generating means provided in said dust-collecting portion; and a suction opening detachably attached to said introducing portion.

With the structure thus made, the airflow sucked from the suction opening passes through the introducing portion of the dust-collecting portion, and then it is introduced into the cyclonic portion formed integrally with the introducing portion, so that it is converted into a vortex flow by the vortex flow generating member within the cyclonic portion, whereby the dusts are separated from the vortex flow by a centrifugal force developed inside the dust box, and then it is discharged to the outside of the cleaner body through the electric fan motor. The dusts collected in the cyclonic portion can be dumped by detaching the dust-collecting portion together with the introducing portion.

A cyclonic vacuum cleaner according to a second aspect of the invention is the one set forth in the first aspect, in which the vortex flow generating member is provided detachably from the dust-collecting portion.

With the structure thus made, the maintenance of the cyclonic portion and the introducing portion can be performed easily by detaching the dust-collecting portion from the cleaner body and then detaching the vortex flow generating member from the dust-collecting portion.

A cyclonic vacuum cleaner according to a third aspect of the invention is the one set forth in the first aspect, in which the vortex flow generating member is formed integrally with the dust-collecting portion.

Thus, it is possible to provide a cyclonic vacuum cleaner of which the possibility of airflow leakage is further reduced.

A cyclonic vacuum cleaner according to a fourth aspect of the invention is the one set forth in any one of the first to third aspects, in which the cleaner further comprises: an opening formed in one end where said dust-collecting portion is attached to said cleaner body; and an introducing opening provided on the one end side for communicating said introducing portion with said cyclonic portion, said introducing opening being formed so as to be open in a crosswise direction relative to an axis of said introducing portion, wherein said vortex flow generating member is provided on the one end side while said introducing portion is formed cylindrical.

With the structure thus made, the possibility of airflow leakage that might take place between the introducing portion and the cyclonic portion is still further reduced.

A cyclonic vacuum cleaner according to a fifth aspect of the invention is the one set forth in the fourth aspect, in which said introducing opening is so constructed that it may be open to a tangential direction of a sidewall of said cyclonic portion.

Thus, it is possible to efficiently generate a vortex flow within the cyclonic portion.

A cyclonic vacuum cleaner according to a sixth aspect of the invention is the one set forth in the fourth or fifth aspect, in which the cleaner further comprises: an introducing wall for introducing the airflow from said introducing portion into said introducing opening, said introducing wall being formed so as to define a smoothly curved surface, wherein one end of said introducing portion is closed in an axial direction thereof.

Thus, the airflow from the introducing portion can be introduced smoothly into the introducing opening owing to the introducing wall.

BRIEF DESCRIPTION OF THE DRAWINGS

For a more complete understanding of the present invention, reference is now made to the following description taken in conjunction with the accompanying drawings, in which.

DESCRIPTION OF THE PREFERRED EMBODIMENTS

Hereunder is a description of a first embodiment of the present invention with reference to FIG. 1 to FIG. 8. In the following description of the embodiment, front and rear of the vacuum cleaner as well as top and bottom thereof are defined on the basis of the posture illustrated in FIG. 1 to FIG. 3.

Figure 1:
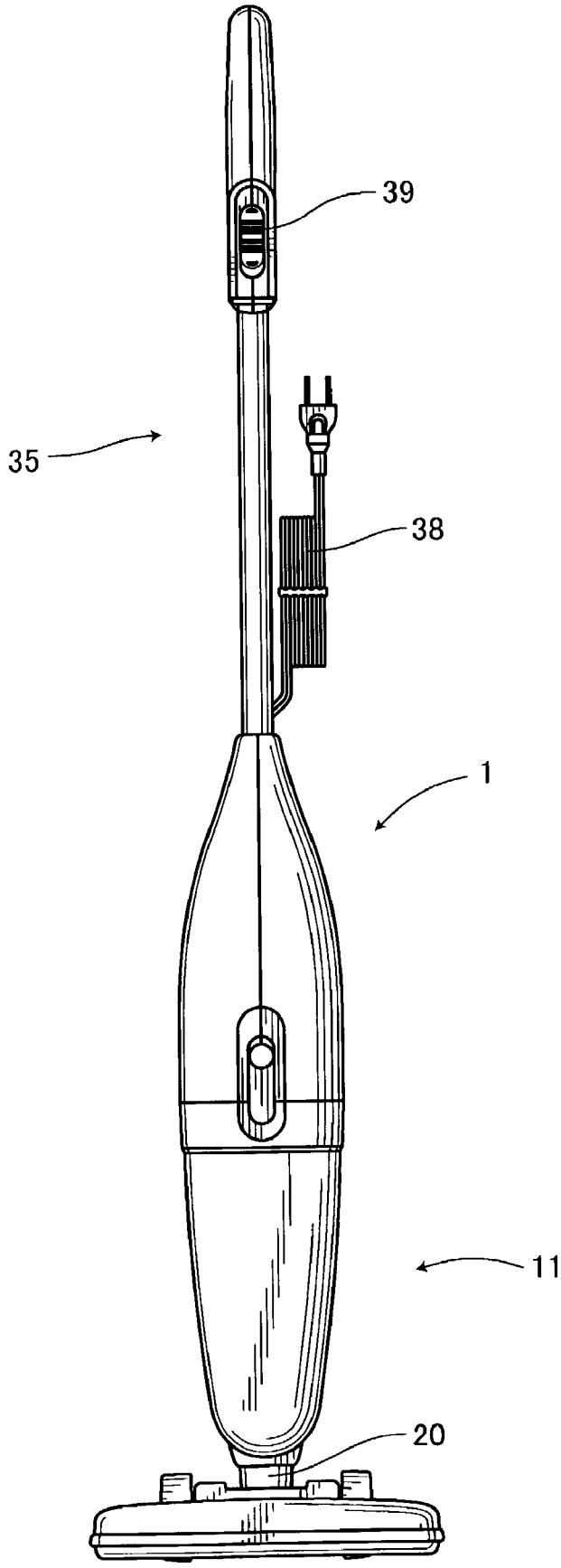
FIG. 1 is a front view showing a cyclonic vacuum cleaner according to a first embodiment of the present invention.
Figure 2:
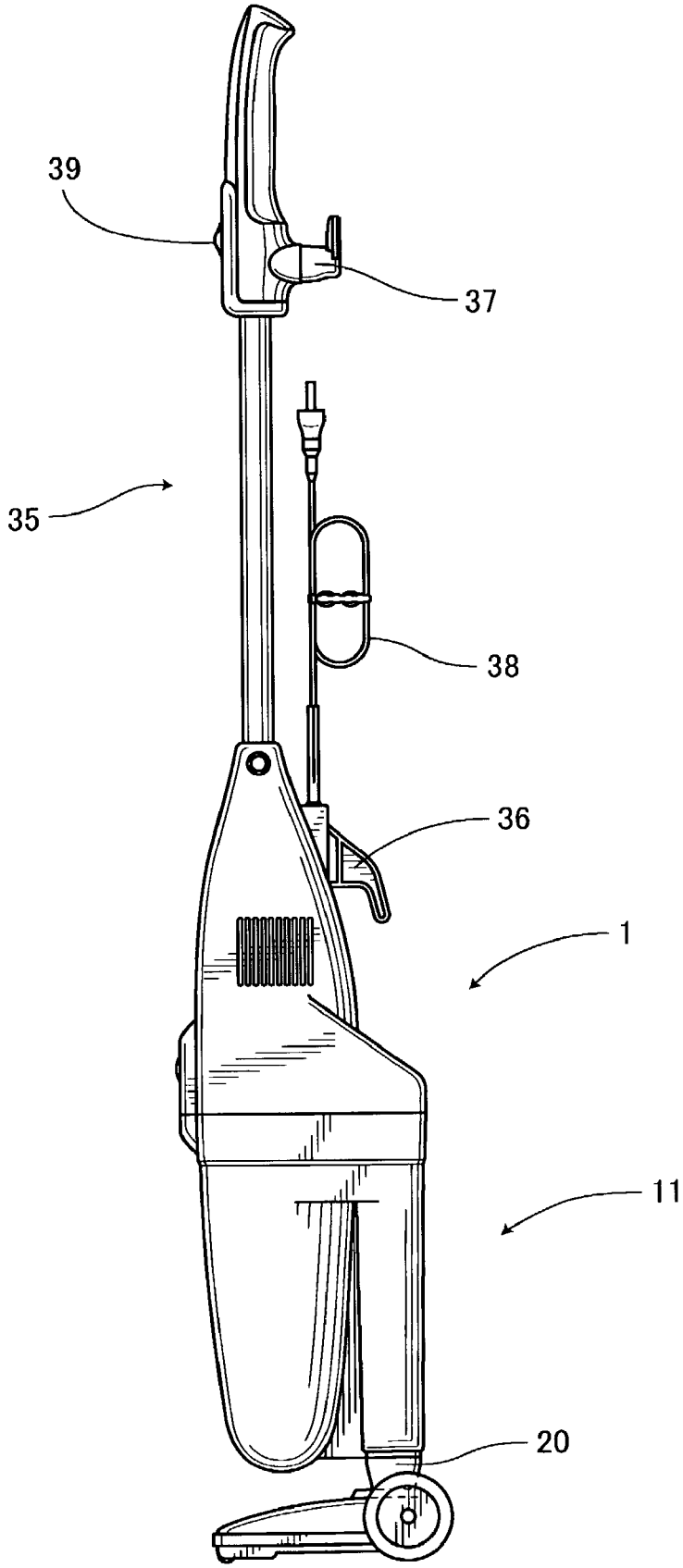
FIG. 2 is a side view of the cyclonic vacuum cleaner of FIG. 1.
Figure 3:
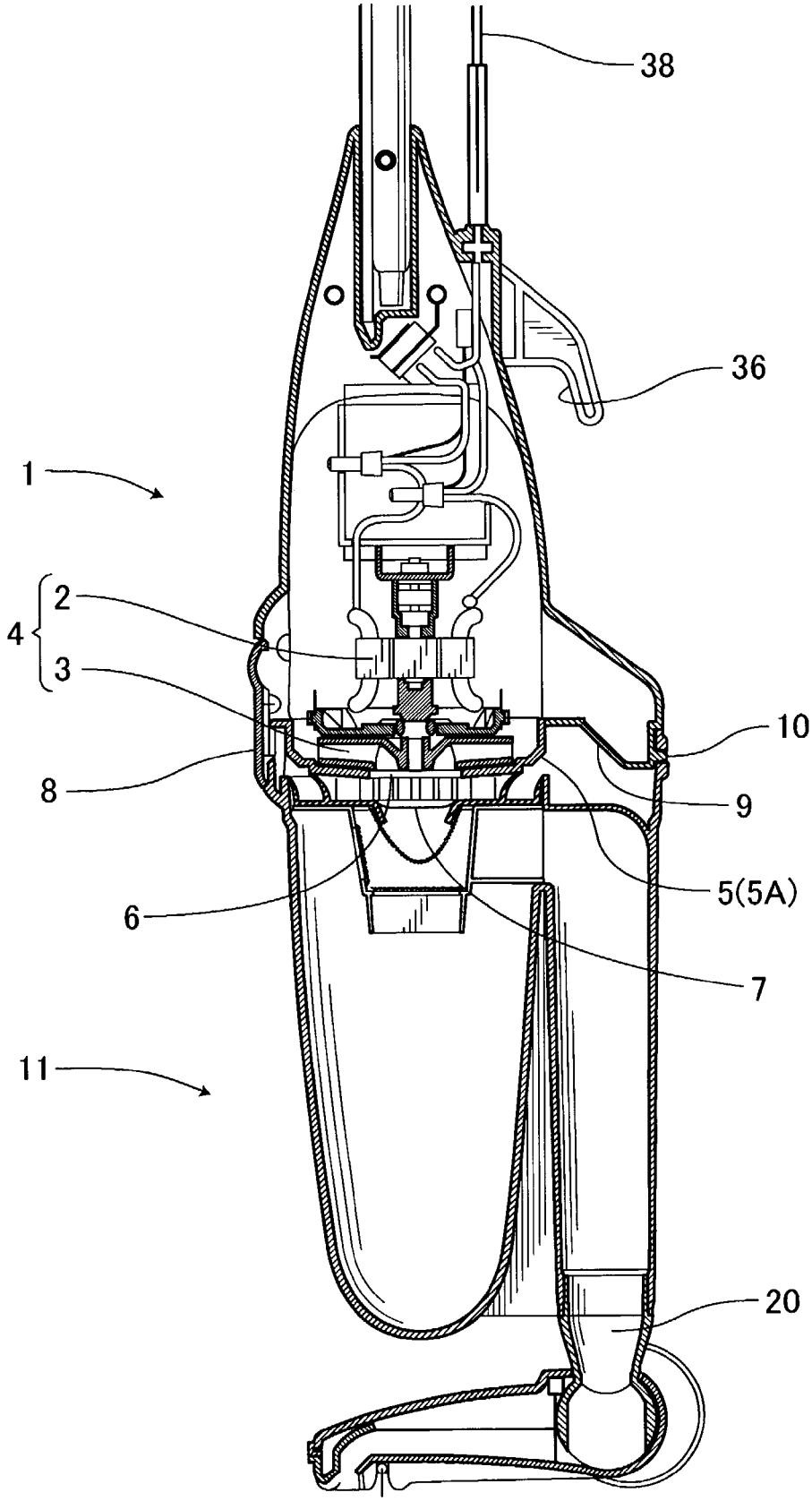
FIG. 3 is an enlarged cross-sectional view of the cyclonic vacuum cleaner of FIG. 1.
Figure 4:
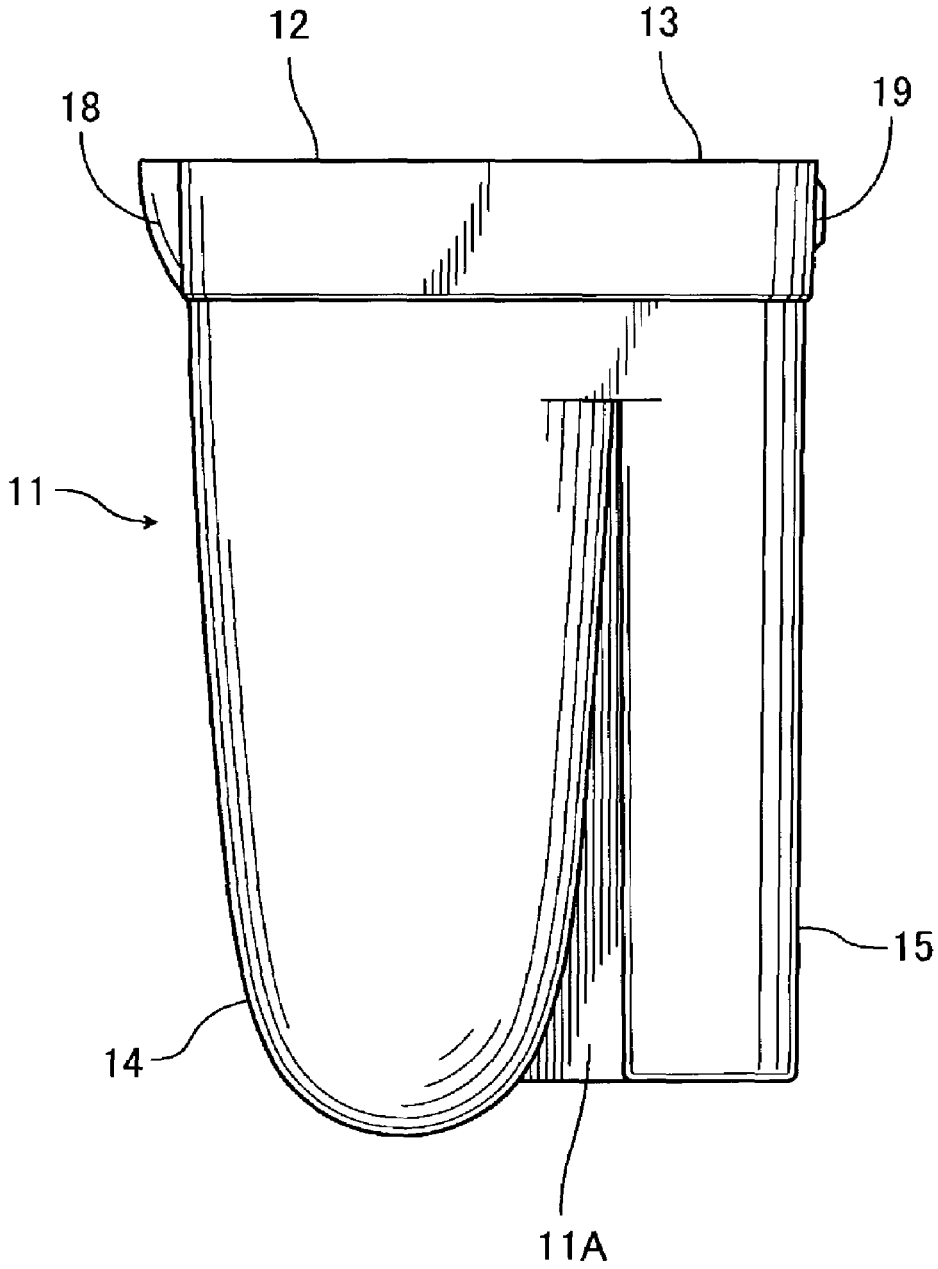
FIG. 4 is a side view of a dust-collecting portion of the cyclonic vacuum cleaner of FIG. 1.
Figure 5:
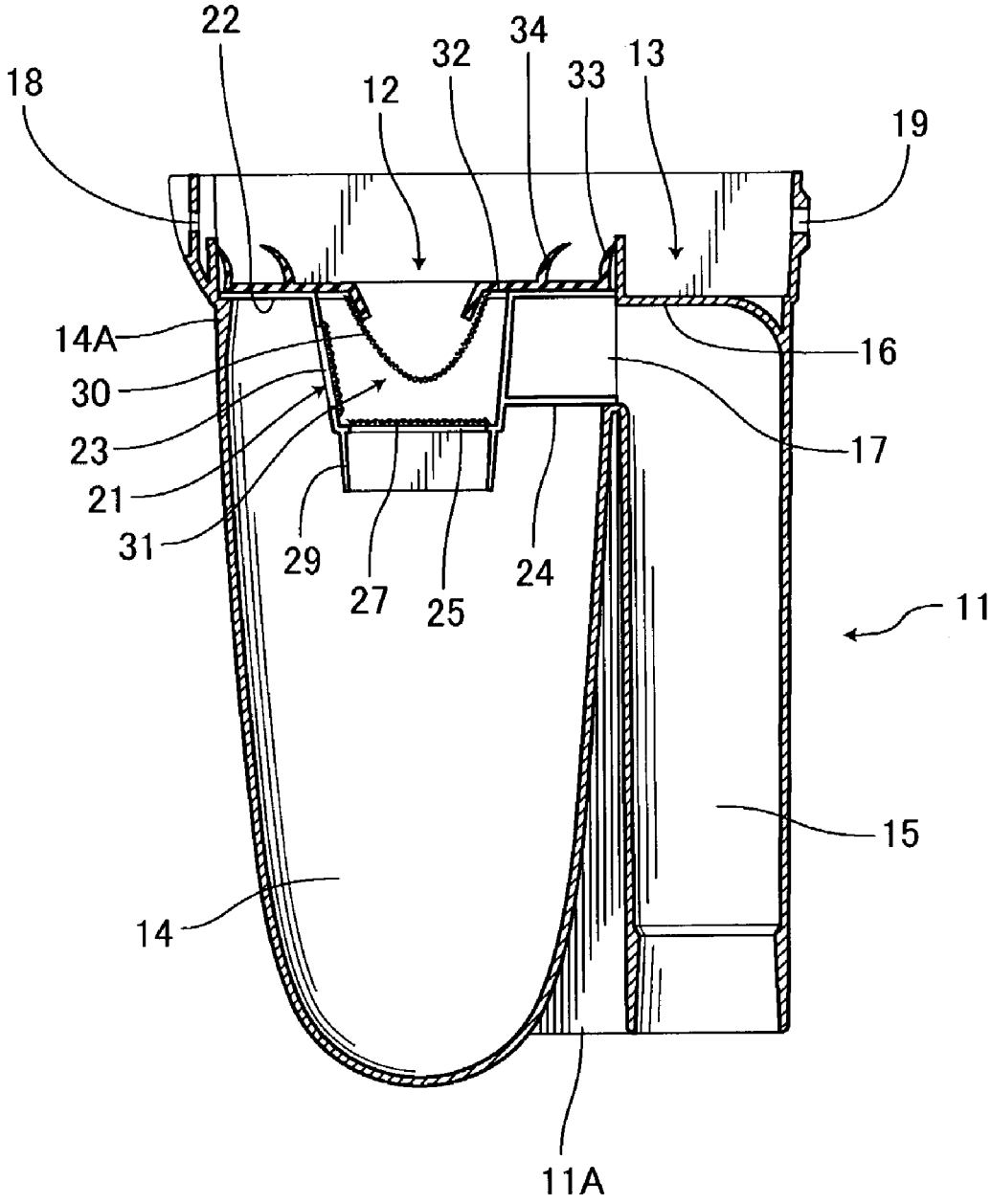
FIG. 5 is a cross-sectional view of the dust-collecting portion of the cyclonic vacuum cleaner of FIG. 1.
Figure 6:
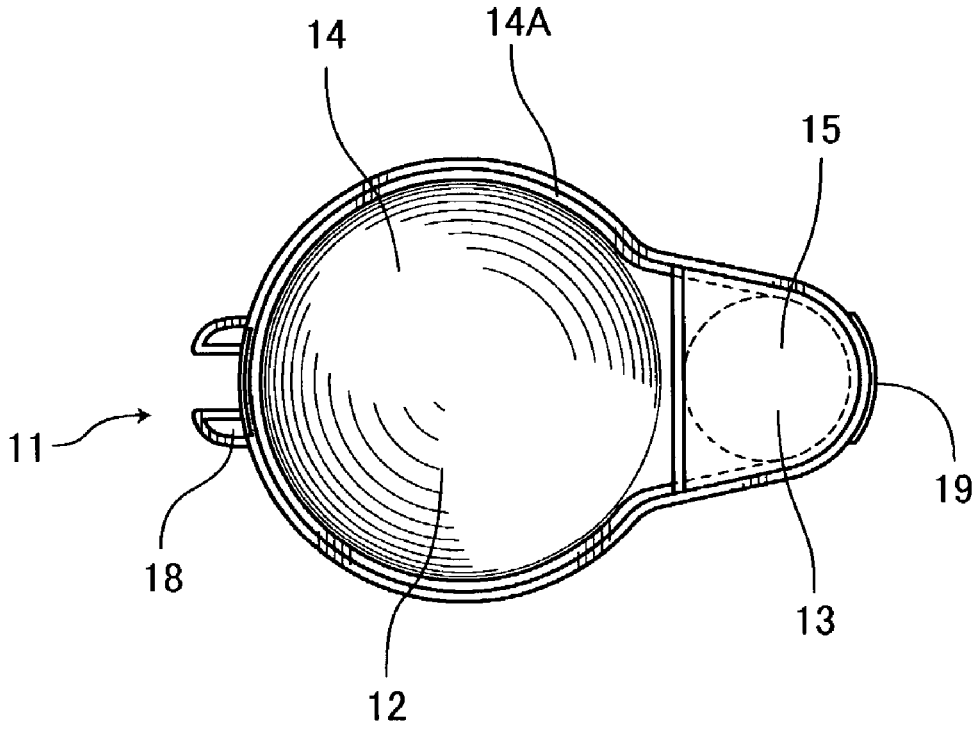
FIG. 6 is a plan view of the dust-collecting portion of the cyclonic vacuum cleaner of FIG. 1.
Figure 7:
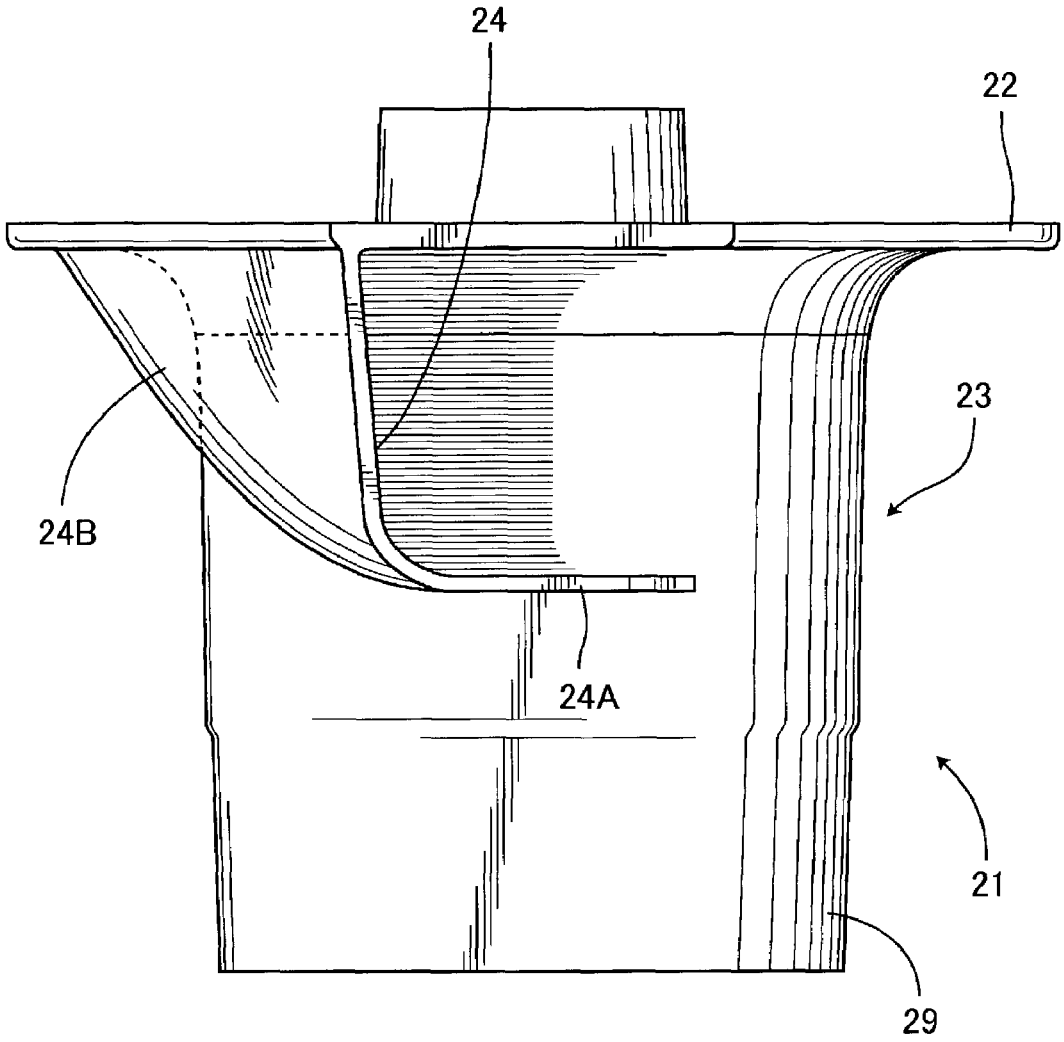
FIG. 7 is a side view of a vortex flow generating member of the cyclonic vacuum cleaner of FIG. 1.
Figure 8:
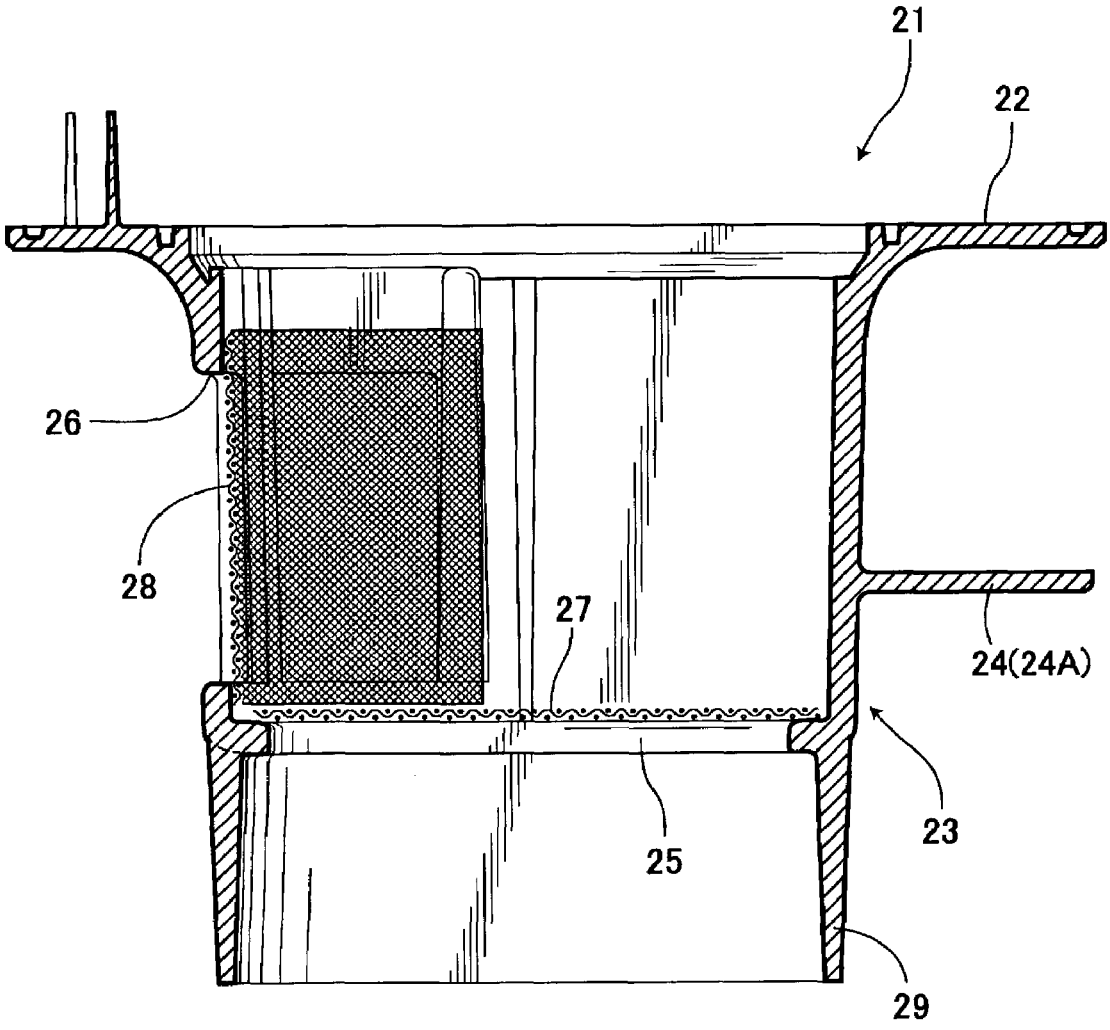
FIG. 8 is cross-sectional view of the vortex flow generating member of the cyclonic vacuum cleaner of FIG. 1.

In FIG. 1 to FIG. 3, numeral 1 denotes a cleaner body. Inside the cleaner body 1 are provided an electric motor 2 and a fan 3 fitted to a rotating shaft of the electric motor 2, thus constructing a motor fan unit 4. In a lower portion of the cleaner body 1 is provided a guide portion 5 which has an approximately short cylindrical shape, including a flat lower end portion 5A. The guide portion 5 is formed with an intake hole 6 which is open downward, so that a lower portion of the guide portion 5 is communicated with the motor fan unit 4 through the intake hole 6. Further, the guide portion 5 is formed with a protective frame 7 so as to cover the intake hole 6. A movable hook 8 is provided on a front side of the guide portion 5, while a convex portion 9 protruding downward is formed on a rear side of the guide portion 5, with a fixed hook 10 protruding backward being formed on a side face of the convex portion 9. Thus, the cleaner body 1 is constructed so as to have such a simple structure as above described.

A resinous dust-collecting portion 11 is detachably attached to a lower portion of the cleaner body 1. The dust-collecting portion 11 is formed on its top with a first opening 12 for inserting the guide portion 5 thereinto and a second opening 13 for inserting the convex portion 9 thereinto. Below the first opening 12 is formed a cyclonic portion 14 which is of an approximately cylindrical shape, being tapered toward a lower end having a bottom, while below the second opening 13 is formed an introducing portion 15 which has an cylindrical inside surface, extending substantially in parallel with an axial direction of the cyclonic portion 14. These cyclonic portion 14 and the introducing portion 15 are formed integrally from a common member.

As an introducing wall 16 is formed between the introducing portion 15 and the second opening 13, an upper end of the introducing portion 15 is closed, while a introducing opening 17 is formed on a sidewall between an upper portion of the cyclonic portion 14 and the vicinity of the upper end of the introducing portion 15. Thereby, a path from a lower end of the introducing portion 15 to the cyclonic portion 14 via the introducing portion 15 and the introducing opening 17 are formed integrally from a common member. In addition, the introducing wall 16 is formed in a smoothly curved surface in order to curve a direction of airflow coming up through the introducing portion 15 smoothly to a direction perpendicular to the axis of the introducing portion 15 to guide the airflow from the introducing opening 17 to the cyclonic portion 14.

Further, a first receiving portion 18 engaging the movable hook 8 is formed on a front side of the first opening 12 and a second receiving portion 19 engaging the fixed hook 10 is formed on a rear side of the second opening 13. In addition, reference symbol 11A denotes a rib, which is formed integrally with a portion between the cyclonic portion 14 and the introducing portion 15 to link these two portions in order to enhance the dust-collecting portion 11 in stiffness. As just described, the dust-collecting portion 11 is simple in structure. Further, a nozzle 20 as the sucking nozzle is attached to a lower end of the introducing portion 15 in a detachable manner.

Moreover, a vortex flow generating member 21 that is a vortex flow generating means is attached to the first opening 12 in a detachable manner. The vortex flow generating member 21 comprises a flange portion 22 mounted on a step portion 14A between the first opening 12 and the cyclonic portion 14, a short cylinder-shaped base portion 23 formed integrally with the flange portion 22, an airflow guiding portion 24 formed on a side face of the base portion 23, a sloping introducing portion 24B provided consecutively with a portion between the flange portion 22 and a bottom 24A of the airflow guiding portion 24, a first ventilating hole 25 formed on a lower end of the base portion 23, a second ventilating hole 26 formed on a side face of the base portion 23, filters 27, 28 provided respectively in the first and the second ventilating hole 25, 26, and an approximately short cylinder-shaped skirt portion 29 provided on an outer periphery of the first ventilating hole 25. Further, the vortex flow generating member 21 is attached to the first opening 12 so that the airflow guiding portion 24 may be positioned, facing to the introducing opening 17. A filter member 31 equipped with a pouched filter 30 is provided on an upper portion of the vortex flow generating member 21. A frame 32 of the filter member 31 is formed from flexible resin or rubber and a seal portion 33 formed on an outer periphery of the frame 32 is so constructed as to be able to contact closely an inner periphery of the first opening 12. Further, a lip portion 34 is formed on an upper portion of the frame 32 and when the dust-collecting portion 11 attached with the vortex flow generating member 21 and the filter member 31 is attached to the cleaner body 1, the lip portion 34 can contact closely a lower end 5A of the guide portion 5 so as to surround the intake hole 6.

In addition, numeral 35 denotes a gripper attached to the cleaner body 1 in a detachable manner. Further, each of hooks 36, 37 is formed respectively on the cleaner body 1 and the gripper 35, allowing a power cord 38 extending from a portion of the cleaner body 1 between these hooks 36, 37 to be wound around them. Further, a power switch-operating portion 39 is provided on the gripper 35.

Next is a description of the behaviors of a cyclonic vacuum cleaner according to the present embodiment. In the first place, users attach the vortex flow generating member 21 and the filter member 31 to the first opening 12 of the dust-collecting portion 11. At that moment, the seal portion 33 of the filter member 31 contacts closely an inner wall of the first opening 12. Then, after allowing the second receiving portion 19 of the dust-collecting portion 11 to engage with the fixed hook 10, the first receiving portion 18 is allowed to engage with the movable hook 8, so that the dust-collecting portion 11 is attached to the cleaner body 1. At that moment, the guide portion 5 is inserted into the first opening 12 and the convex portion 9 is also inserted into the second opening 13, so that the dust-collecting portion 11 is properly positioned relative to the cleaner body 1. Further, the lip portion 34 of the filter member 31 contacts closely a lower end 5A of the guide portion 5 in a manner that surrounds the intake hole 6. Accordingly, a path from the inside of the cyclonic portion 14 to the intake hole 6 is sealed. Then, the nozzle 20 is attached to the lower end of the introducing portion 15.

Then, a power cord 38 is detached from the hooks 36, 37 so that it is connected to a power receptacle (not shown), operating the power switch-operating portion 39, so that the motor fan unit 4 is actuated. Then, dust-laden airflow is sucked from the nozzle 20 by the actuation of the motor fan unit 4. The airflow is sucked from the nozzle 20 to rise within the introducing portion 15, changing its flowing direction so as to flow along the introducing wall 16 at an upper end of the introducing portion 15, so that the airflow is introduced from the introducing opening 17 into the cyclonic portion 14. At this moment, as the path from the lower end of the introducing portion 15 to the cyclonic portion 14 via the introducing portion 15 and the introducing opening 17 is formed integrally from a common member, there is little, if any, possibility of airflow leakage occurring in a zone defined by the path. The airflow thus introduced into the cyclonic portion 14 is guided by the airflow guiding portion 24 formed on the side face of the base portion 23 of the aforesaid vortex flow generating member 21 to thereby be converted into a vortex flow along an inner peripheral surface of the cyclonic portion 14. When the vortex flow has made a round along the cyclonic portion 14, it is then guided downward by the sloping introducing portion 24B, so that the vortex flow descends spirally. At that moment, dusts contained in the vortex flow are pressed to an inner peripheral surface of the cyclonic portion 14 by centrifugal force. Then, when the vortex flow reaches a bottom of the cyclonic portion 14, the vortex flow having been descending on the side of the inner peripheral surface of the cyclonic portion 14 in turn starts rising in the vicinity of the center portion of the cyclonic portion 14. At that moment, as the dusts contained in the vortex flow are pressed to the inner peripheral surface of the cyclonic portion 14 by centrifugal force as described above, comparatively rough dusts are allowed to stay in the vicinity of the inner peripheral surface of the cyclonic portion 14 so that they are separated from the vortex flow, even if the vortex flow flows toward the vicinity of the center of the cyclonic portion 14 from the side of the inner peripheral surface thereof.

On the other hand, comparatively fine dusts, which are being mixed in the vortex flow, are moved to the vicinity of the center of the cyclonic portion 14 and start to ascend in the cyclonic portion 14 in association with the rising of the vortex flow. Then, most of the ascended vortex flows pass through the first ventilating hole 25 formed on a lower portion of the vortex flow generating member 21 positioned at the upper portion, while part of the ascended vortex flows pass through the second ventilating hole 26 formed on a side face of the vortex flow generating member 21. At that moment, comparatively fine dusts contained in the vortex flow are captured by the filters 27, 28 attached to the first and second ventilating holes 25, 26, while still finer dusts having passed through the filters 27, 28 are captured by a filter 30 of a filter member 31 provided on an upper portion of the vortex flow generating member 21.

As described above, most of the vortex flows pass through the first ventilating hole 25 and therefore the filter 27 captures a greater amount of dusts than the filter 28 does, and thus the filter 27 is prone to be clogged with particularly lint or the like. However, since the second ventilating hole 26 is formed on the side face of the vortex flow generating member 21, the vortex flow can pass through the second ventilating hole 26 even if the filter 27 is clogged, so that a certain amount of airflow can always be ensured. Moreover, as the short cylinder-shaped skirt portion 29 is formed on an outer periphery of the first ventilating hole 25, even if the filter 27 is clogged with collected dusts and the ascended vortex flow is urged to flow into the second ventilating hole 26 after hitting on the filter 27, the vortex flow which has hit on the filter 27 must flow beyond the skirt portion 29, so that the captured dusts are restrained from riding such urged airflow, owing to the skirt portion 29, thus preventing the filter 28 from being clogged with dusts. Airflow which has passed through the filters 27, 28 of the vortex flow generating member 21 and the filter 30 of the filter member 31 reaches the motor fan unit 4 through the intake hole 6 to eventually go out of the cleaner body 1.

After cleaning, the nozzle 20 is detached from a lower end of the introducing portion 15 and then the dust-collecting portion 11 is detached from the cleaner body 1 by operating the movable hook 8. Then, the filter member 31 and the vortex flow generating member 21 are detached from the first opening 12, thus removing dusts adherent to the filters 27, 28, 30. The dusts collected in the cyclonic portion 14 are dumped into a trash box. At this moment, as the cyclonic portion 14 is integrally formed with the introducing portion 15 in the dust-collecting portion 11, not only can the dusts within the cyclonic portion 14 be easily dumped but also can those collected in the introducing portion 15 be easily removed with the light dust-collecting portion 11 being held by a hand. Accordingly, even if sheet-like matter or the like is sucked so that the introducing portion 15 or introducing opening 17 is clogged therewith during cleaning, yet it can be easily removed. Further, as the dust-collecting portion 11 is made of resin and is formed into one piece structure, it can be washed with water, so that the cyclonic portion 14 and the introducing portion 15 can be kept cleaner through such wet-cleaning.

As described above, a cyclonic vacuum cleaner according to the present embodiment comprises the cleaner body 1 with the motor fan unit 4 and the dust-collecting portion 11 detachably attached to the cleaner body 1, wherein the dust-collecting portion 11 comprises the cyclonic portion 14 which is approximately cylinder-shaped, having a bottom; the introducing portion 15 for introducing dust-laden airflow into the cyclonic portion 14, said introducing portion 15 being formed integrally with said cyclonic portion 14; the vortex flow generating member 21 serving as a vortex flow generating means; and the nozzle 20 serving as a sucking nozzle, said nozzle 20 being detachably attached to the introducing portion 15.

Hence, airflow sucked from the nozzle 20 passes through the introducing portion 15 of the dust-collecting portion 11 to thereby be introduced into the cyclonic portion 14 formed integrally with the introducing portion 15, so that it is converted into a vortex flow within the cyclonic portion 14 by the vortex flow generating member 21, whereby dusts are separated therefrom by centrifugal force and then the airflow passes through the motor fan unit 4 to be discharged to the outside of the cleaner body 1.

The dusts collected in the cyclonic portion 14 are dumped by detaching the dust-collecting portion 11 together with the introducing portion 15. Accordingly, not only can the structure of the cleaner body 1 be simplified despite the fact that a cyclonic vacuum cleaner tends to become too complex in structure, but the maintenance of the introducing portion 15 as well as that of the cyclonic portion 14 can be easily performed since dusts collected in the cyclonic portion 14 can be dumped through the detachment of the dust-collecting portion 11 together with the introducing portion 15. Further, as the structure from the introducing portion 15 to the cyclonic portion 14 is simplified thus way and therefore the number of components can be decreased, it is possible to reduce the manufacturing costs. Also, as there is no joint between the introducing portion 15 and the cyclonic portion 14, it is possible to diminish the number of joints in the whole cyclonic vacuum cleaner, and thus it is possible to reduce the possibility of airflow leakage that might take place in a suction passage, thereby enabling the enhancement of the dust-collecting performance.

Furthermore, as the vortex flow generating member 21 is provided in the dust-collecting portion 11 in a detachable manner, the maintenance of the cyclonic portion 14 and the introducing portion 15 can be easily performed by detaching the dust-collecting portion 11 from the cleaner body 1 and then detaching the vortex flow generating member 21 from the dust-collecting portion 11, thereby enabling the dust-collecting performance to be easily maintained.

Moreover, the cyclonic vacuum cleaner of the embodiment includes: the first opening 12 and the second opening 13 formed in one end where the dust-collecting portion 11 is attached to the cleaner body 1; the vortex flow generating member 21 provided on the one end side; the introducing portion 15 which is formed cylindrical; and the introducing opening 17 provided on the one end side for communicating the introducing portion 15 with the cyclonic portion 14, said introducing opening 17 being formed so as to be open in a crosswise direction relative to the axis of the introducing portion 15, whereby the possibility of airflow leakage that might take place between the introducing portion 15 and the cyclonic portion 14 can be further reduced, so that the dust-collecting performance can be further enhanced.

Further, the introducing portion 15 is closed at the aforesaid one end side in the axial direction thereof, while the introducing wall 16 for introducing the airflow from the introducing portion 15 into the introducing opening 17, said introducing wall 16 being formed so as to define a smoothly curved surface, the airflow from the introducing portion 15 can be introduced smoothly into the introducing opening 17 by the introducing wall 16.

Furthermore, a cyclonic vacuum cleaner of the embodiment is particularly advantageous in that as the rib 11A for linking the cyclonic portion 14 with the introducing portion 15 is formed integrally therebetween, the dust-collecting portion 11 is allowed to have an enhanced stiffness, thus enabling the preventing of the damages to the dust-collecting portion 11.

Figure 9:
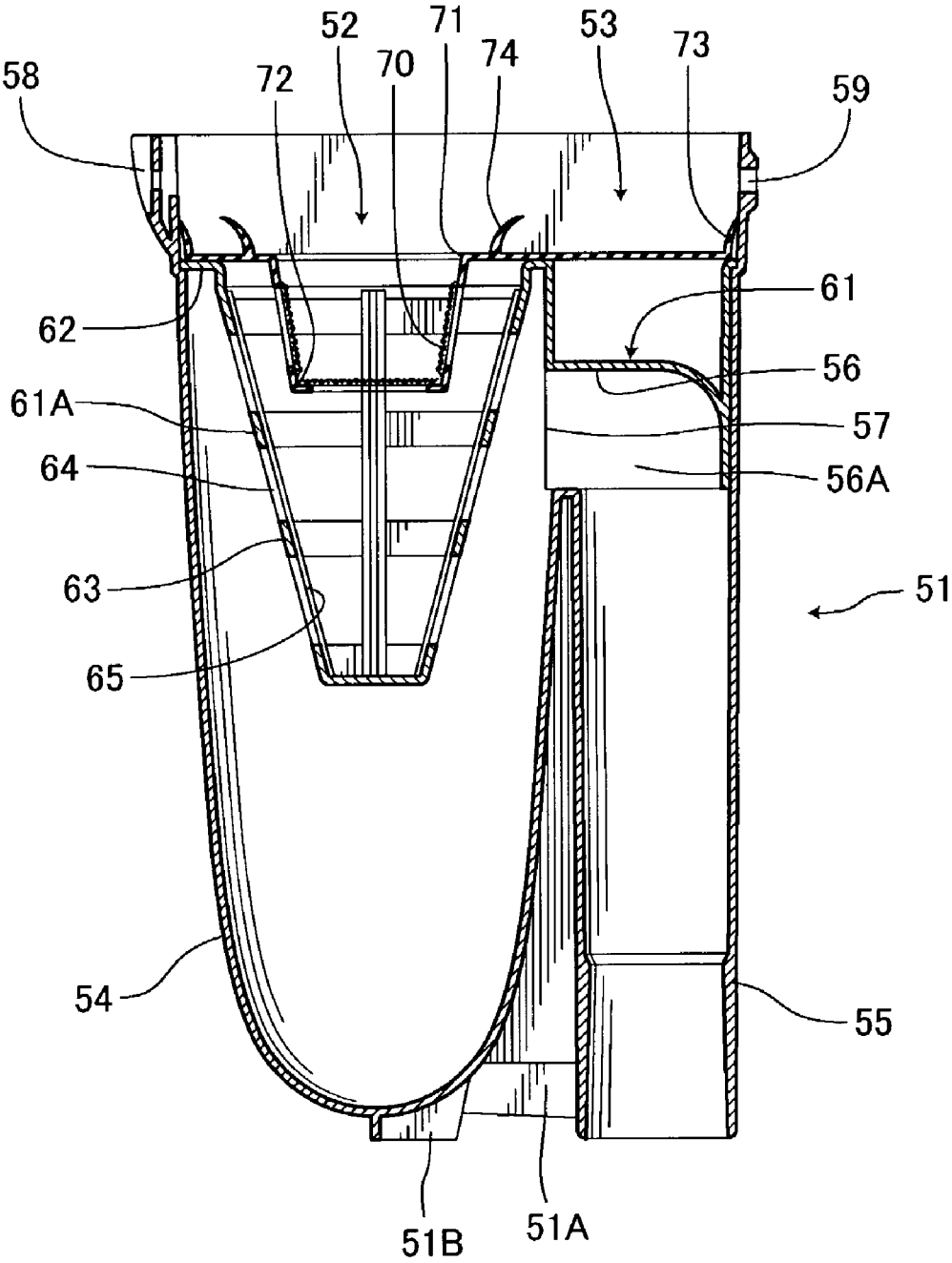
FIG. 9 is a cross-sectional view showing a dust-collecting portion of a cyclonic vacuum cleaner according to a second embodiment of the present invention.
Figure 10:
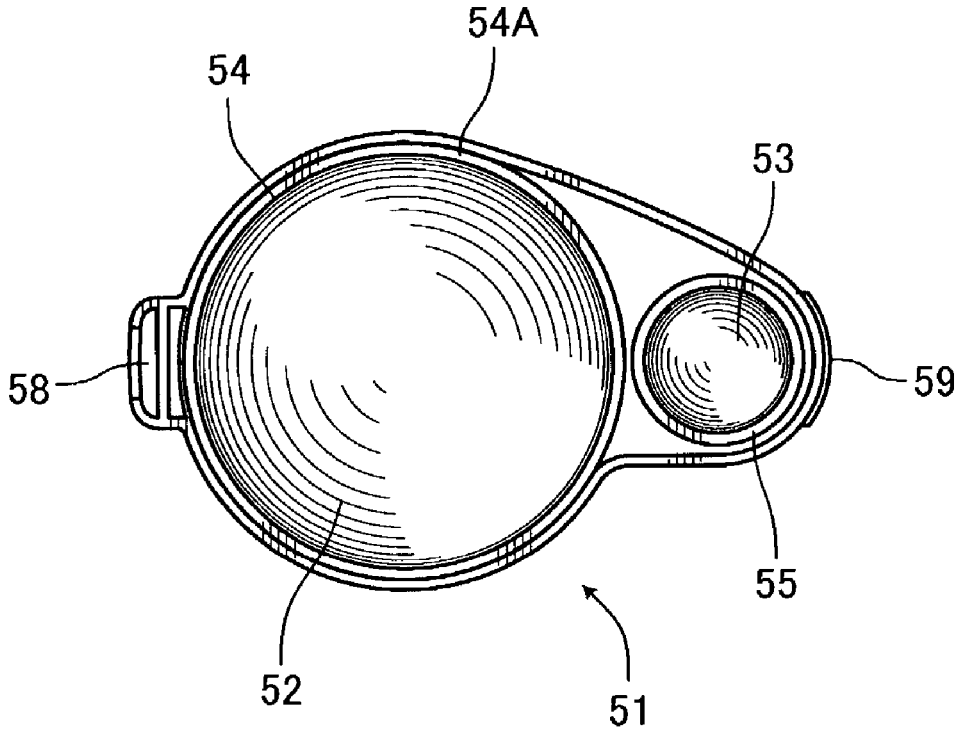
FIG. 10 is a plan view of the dust-collecting portion of the cyclonic vacuum cleaner of FIG. 9.
Figure 11:
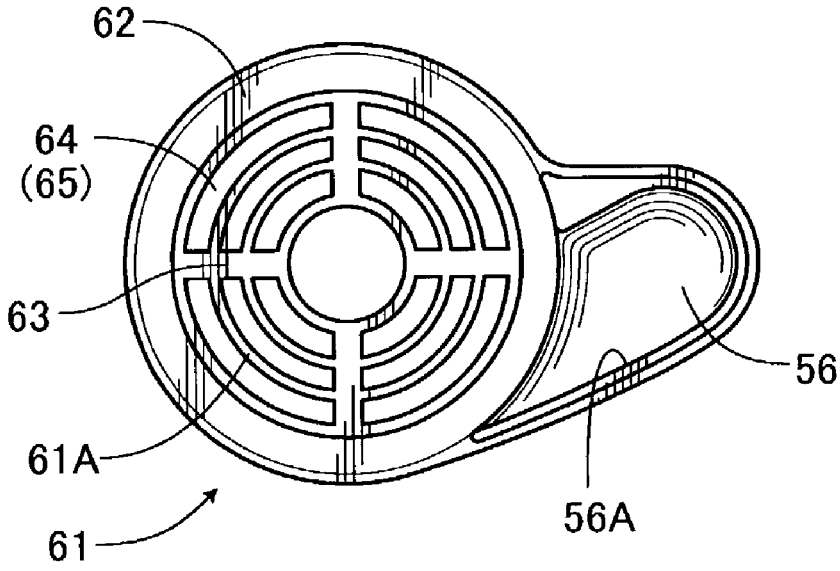
FIG. 11 is a bottom view of a vortex flow generating member of the cyclonic vacuum cleaner of FIG. 9.

Next is a description of a second embodiment of the present invention based on FIG. 9 to FIG. 11, in which the same reference symbols are used for the same parts as those described in the first embodiment, and the repeated detailed description thereof is omitted.

A dust-collecting portion 51 made of resin is detachably attached to a lower portion of the cleaner body 1. The dust-collecting portion 51 is formed at its upper end with a first opening 52 for inserting the aforesaid guide portion 5 thereinto and a second opening 53 for inserting the convex portion 9 thereinto. Below the first opening 52 is formed a cyclonic portion 54 which is of an approximately cylindrical shape, being tapered toward a lower end having a bottom, while below the second opening 53 is formed an introducing portion 55 which has an cylindrical inside surface, extending substantially in parallel with an axial direction of the cyclonic portion 54. These cyclonic portion 54 and the introducing portion 55 are formed integrally from a common member.

Further, a vortex flow generating member 61 is provided in the first opening 52 and the second opening 53. The vortex flow generating member 61 includes a conical portion 61A which is approximately inverted-cone-shaped, and an introducing wall 56 leading to the conical portion 61A, in which the conical portion 61A and the introducing wall 56 are formed integrally from a common member. The vortex flow generating member 61 is detachably attached to the dust-collecting portion 51 so that the conical portion 61A may correspond to the first opening 52, and the introducing wall 56 may correspond to the second opening 53, respectively.

As the introducing wall 56 is provided between the introducing portion 55 and the second opening 53, the upper end of the introducing portion 55 is closed while an introducing opening 57 is formed on a sidewall between an upper portion of the cyclonic portion 54 and the vicinity of the upper end of the introducing portion 55. In the meantime, the introducing wall 56 is formed so as to define a smoothly curved surface in order to smoothly turn the direction of airflow ascending through the introducing portion 55 perpendicularly to the axis of the introducing portion 55 to thereby introduce the airflow from the introducing opening 57 into the cyclonic portion 54. The introducing opening 57 is so constructed that it may be open to the tangential direction of one side of the sidewall in the cyclonic portion 54. More specifically, an introducing sidewall 56A, i.e., a side face of the introducing wall 56 is constructed so that the introducing portion 55 may be connected substantially linearly with the tangential direction of one side of the cyclonic portion 54. Accordingly, the airflow ascending through the introducing portion 55 is urged toward the tangential direction of the one side of the sidewall in the cyclonic portion 54.

The conical portion 61A comprises: a flange portion 62 mounted on a step portion 54A between the first opening 52 and the cyclonic portion 54; a conical base portion 63 formed integrally with the flange portion 62; a ventilating hole 64 provided on a side face of the base portion 63; and a filter 65 provided in the ventilating hole 64. A filter member 71 including a pouched filter 70 is provided on an upper portion of the vortex flow generating member 61. The filter member 71 has a frame 72 formed from flexible resin or rubber while a seal portion 73 formed around an outer periphery of the frame 72 is so constructed that it may closely contact the inner peripheries of the first opening 52 and the second opening 53. Further, a lip portion 74 is formed on a top portion of the frame 72 and is so constructed that it may be able to closely contact the lower end 5A of the guiding portion 5 in a manner that the lip portion 74 surrounds the intake hole 6, when the dust-collecting portion 51 with the vortex flow generating member 61 and the filter member 71 is attached to the cleaner body 1.

Furthermore, a first receiving portion 58 which engages with the movable hook 8 is formed on a front side of the first opening 52 while a second receiving portion 59 which engages with the fixed hook 10 is formed on a rear side of the second opening 53. In the meantime, reference symbol 51A denotes a rib provided for enhancing the stiffness of the dust-collecting portion 51, said rib 51A being integrally formed between the cyclonic portion 54 and the introducing portion 55 so that these two portions are linked to each other. Reference numeral 51B designates a leg 51B which is provided adjacent to the rib 51A and in the vicinity of a lower end of the cyclonic portion 54, said leg 51B being integral with the dust-collecting portion 51. The leg 51B has a lower end formed flush with that of the introducing portion 55 so that the dust-collecting portion 51 is able to stand by itself when the dust-collecting portion 51 is detached from the cleaner body 1. It should be noted that the structure of the dust-collecting portion 51 is simplified thus way. Incidentally, the nozzle 20 serving as a sucking nozzle is attached to a lower end of the introducing portion 55.

Next is a description of the behaviors of a cyclonic vacuum cleaner according to the present embodiment. In the first place, users attach the vortex flow generating member 61 and the filter member 71 to the first opening 52 and the second opening 53 of the dust-collecting portion 51. At that moment, the seal member 73 of the filter member 71 contacts closely the inner walls of the first opening 52 and the second opening 53. Then, after allowing the second receiving portion 59 of the dust-collecting portion 51 to engage with the fixed hook 10, the first receiving portion 58 is allowed to engage with the movable hook 8, so that the dust-collecting portion 51 is attached to the cleaner body 1. At that moment, the guide portion 5 is inserted into the first opening 52 and the convex portion 9 is also inserted into the second opening 53, so that the dust-collecting portion 51 is properly positioned relative to the cleaner body 1. Further, the lip portion 74 of the filter member 71 contacts closely the lower end 5A of the guide portion 5 in a manner that surrounds the intake hole 6. Accordingly, a path from the inside of the cyclonic portion 54 to the intake hole 6 is sealed. Then, the nozzle 20 is attached to the lower end of the introducing portion 55.

Then, a power cord 38 is detached from the hooks 36, 37 so that it is connected to a power receptacle (not shown), operating the power switch-operating portion 39, so that the motor fan unit 4 is actuated. Then, dust-laden airflow is sucked from the nozzle 20 by the actuation of the motor fan unit 4. The airflow is sucked from the nozzle 20 to rise within the introducing portion 55, changing its flowing direction so as to flow along the introducing wall 56 at an upper end of the introducing portion 55, so that the airflow is introduced from the introducing opening 57 into the cyclonic portion 54 while flowing along the direction tangential to the one side of the sidewall of the cyclonic portion 54.

The airflow thus introduced into the cyclonic portion 54 is allowed to flow along the inner peripheral surface of the cyclonic portion 54 so that it is converted into a vortex flow and then it descends spirally. At that moment, dusts contained in the vortex flow are pressed to an inner peripheral surface of the cyclonic portion 54 by centrifugal force. Then, when the vortex flow reaches a bottom of the cyclonic portion 54, the vortex flow having been descending on the side of the inner peripheral surface of the cyclonic portion 54 in turn starts rising in the vicinity of the center of the cyclonic portion 54. At that moment, as the dusts contained in the vortex flow are pressed to the inner peripheral surface of the cyclonic portion 54 by centrifugal force as described above, comparatively rough dusts are allowed to stay in the vicinity of the inner peripheral surface of the cyclonic portion 54 so that they are separated from the vortex flow, even if the vortex flow flows toward the vicinity of the center of the cyclonic portion 54 from the side of the inner peripheral surface thereof.

On the other hand, comparatively fine dusts, which are being mixed in the vortex flow, are moved to the vicinity of the center of the cyclonic portion 54 and start to ascend in the cyclonic portion 54 in association with the rising of the vortex flow. Then, the ascended vortex flow passes through the ventilating hole 64 formed on a side surface of the vortex flow generating member 61 positioned at the upper portion. At that moment, comparatively fine dusts contained in the vortex flow are captured by the filter 65 attached to the ventilating hole 64, while still finer dusts having passed through the filter 65 are captured by the filter 70 of the filter member 71 provided on an upper portion of the vortex flow generating member 61. Airflow which has passed through the filter 65 of the vortex flow generating member 61 and the filter 70 of the filter member 71 reaches the motor fan unit 4 through the intake hole 6 to eventually go out of the cleaner body 1.

After cleaning, the nozzle 20 is detached from a lower end of the introducing portion 55 and then the dust-collecting portion 51 is detached from the cleaner body 1 by operating the movable hook 8. Then, the filter member 71 and the vortex flow generating member 61 are detached from the first opening 52 and the second opening 53, thus removing dusts adherent to the filters 65, 70. The dusts collected in the cyclonic portion 54 are dumped into a trash box. At this moment, as the cyclonic portion 54 is integrally formed with the introducing portion 55 in the dust-collecting portion 51, not only can the dusts within the cyclonic portion 54 be easily dumped but also can those collected in the introducing portion 55 be easily removed with the light dust-collecting portion 51 being held by a hand. Accordingly, even if sheet-like matter or the like is sucked so that the introducing portion 55 or introducing opening 57 is clogged therewith during cleaning, yet it can be easily removed. Specifically, the introducing wall 56 serving as a part of the vortex flow generating member 61 is provided detachably from the dust-collecting portion 51 and thus the introducing portion 55 is allowed to define a through-hole in the vertically axial direction when the vortex flow generating member 61 is detached, whereby if the introducing portion 55 is clogged with something, yet it can be easily removed, thus displaying excellent maintainability.

Further, as the dust-collecting portion 51 is made of resin and is formed into one piece structure, it can be washed with water, so that the cyclonic portion 54 and the introducing portion 55 can be kept cleaner through such wet-cleaning. Still further, due to the leg 51B provided in the vicinity of the lower end of the cyclonic portion 54 and the lower end of the introducing portion 55, the dust-collecting portion 51 is allowed to be able to stand by itself with the first opening 52 and the second opening 53 facing upward. Hence, the dust-collecting portion 51 can be temporarily put on a flat place without littering the dusts, in the case of dumping dusts or in the like cases, and thus it is convenient to users.

As described above, a cyclonic vacuum cleaner according to the present embodiment comprises the cleaner body 1 with the motor fan unit 4 and the dust-collecting portion 51 detachably attached to the cleaner body 1, wherein the dust-collecting portion 51 comprises the cyclonic portion 54 which is approximately cylinder-shaped, having a bottom;

the introducing portion 55 for introducing dust-laden airflow into the cyclonic portion 54, said introducing portion 55 being formed integrally, with said cyclonic portion 54; the vortex flow generating member 61 serving as a vortex flow generating means provided in the dust-collection portion 51; and the nozzle 20 serving as a sucking nozzle, said nozzle 20 being detachably attached to the introducing portion 55.

Hence, airflow sucked from the nozzle 20 passes through the introducing portion 55 of the dust-collecting portion 51 to thereby be introduced into the cyclonic portion 54 formed integrally with the introducing portion 55, so that it is converted into a vortex flow within the cyclonic portion 54 by the vortex flow generating member 61, whereby dusts are separated therefrom by centrifugal force and then the airflow passes through the motor fan unit 4 to be discharged to the outside of the cleaner body 1.

The dusts collected in the cyclonic portion 54 are dumped by detaching the dust-collecting portion 51 together with the introducing portion 55. Accordingly, not only can the structure of the cleaner body 1 be simplified despite the fact that a cyclonic vacuum cleaner tends to become too complex in structure, but the maintenance of the introducing portion 55 as well as that of the cyclonic portion 54 can be easily performed since dusts collected in the cyclonic portion 54 can be dumped through the detachment of the dust-collecting portion 51 together with the introducing portion 55. Further, as the structure from the introducing portion 55 to the cyclonic portion 54 is simplified thus way and therefore the number of components can be decreased, it is possible to reduce the manufacturing costs. Also, as there is only one joint between the introducing portion 55 and the cyclonic portion 54, it is possible to diminish the number of joints in the whole cyclonic vacuum cleaner, and thus it is possible to reduce the possibility of airflow leakage that might take place in a suction passage, thereby enabling the enhancement of the dust-collecting performance.

Furthermore, as the vortex flow generating member 61 is provided in the dust-collecting portion 51 in a detachable manner, the maintenance of the cyclonic portion 54 and the introducing portion 55 can be easily performed by detaching the dust-collecting portion 51 from the cleaner body 1 and then detaching the vortex flow generating member 61 from the dust-collecting portion 51, thereby enabling the dust-collecting performance to be easily maintained.

Moreover, the cyclonic vacuum cleaner of the embodiment includes: the first opening 52 and the second opening 53 formed in one end where the dust-collecting portion 51 is attached to the cleaner body 1; the vortex flow generating member 61 provided on the one end side; the introducing portion 55 which is formed cylindrical; and the introducing opening 57 provided on the one end side for communicating the introducing portion 55 with the cyclonic portion 54, said introducing opening 57 being formed by providing said vortex flow generating member 61 so as to be open in a crosswise direction relative to the axis of the introducing portion 55, whereby the introducing portion 55 is opened to its axial direction by detaching the vortex flow generating member 61 from the dust-collecting portion 51, and thus it is possible to maintain the dust-collecting portion 51 more easily, thus enabling the dust-collecting performance to be retained.

Still further, as the introducing opening 57 is so constructed that it may be open to the tangential direction relative to the sidewall of the cyclonic portion 54, it is possible to efficiently generate the vortex flow within the cyclonic portion 54. Still also, as the one end of the introducing portion 55 is closed in its axial direction by said vortex flow generating member 61, while the said vortex flow generating member 61 includes the introducing wall 56 for introducing the airflow from the introducing portion 55 into the introducing opening 57, said introducing wall 56 being formed so as to define a smoothly curved surface, the airflow from the introducing portion 55 can be introduced smoothly into the introducing opening 57 by the introducing wall 56.

Furthermore, a cyclonic vacuum cleaner of the embodiment is advantageous in that as the rib 51A for linking the cyclonic portion 54 with the introducing portion 55 is formed integrally therebetween, the dust-collecting portion 51 is allowed to have an enhanced stiffness, thus enabling the preventing of the damages to the dust-collecting portion 51.

In addition to the foregoing, as the leg 51B is provided integrally with the dust-collecting portion 51 in the vicinity of the lower end of the cyclonic portion 54, in such a manner that the lower end of the leg 51B is flush with that of the introducing portion 55, the dust-collecting portion 51 is allowed to be able to stand by itself on a flat place when the dust-collecting portion 51 is detached from the cleaner body 1.

Figure 12:
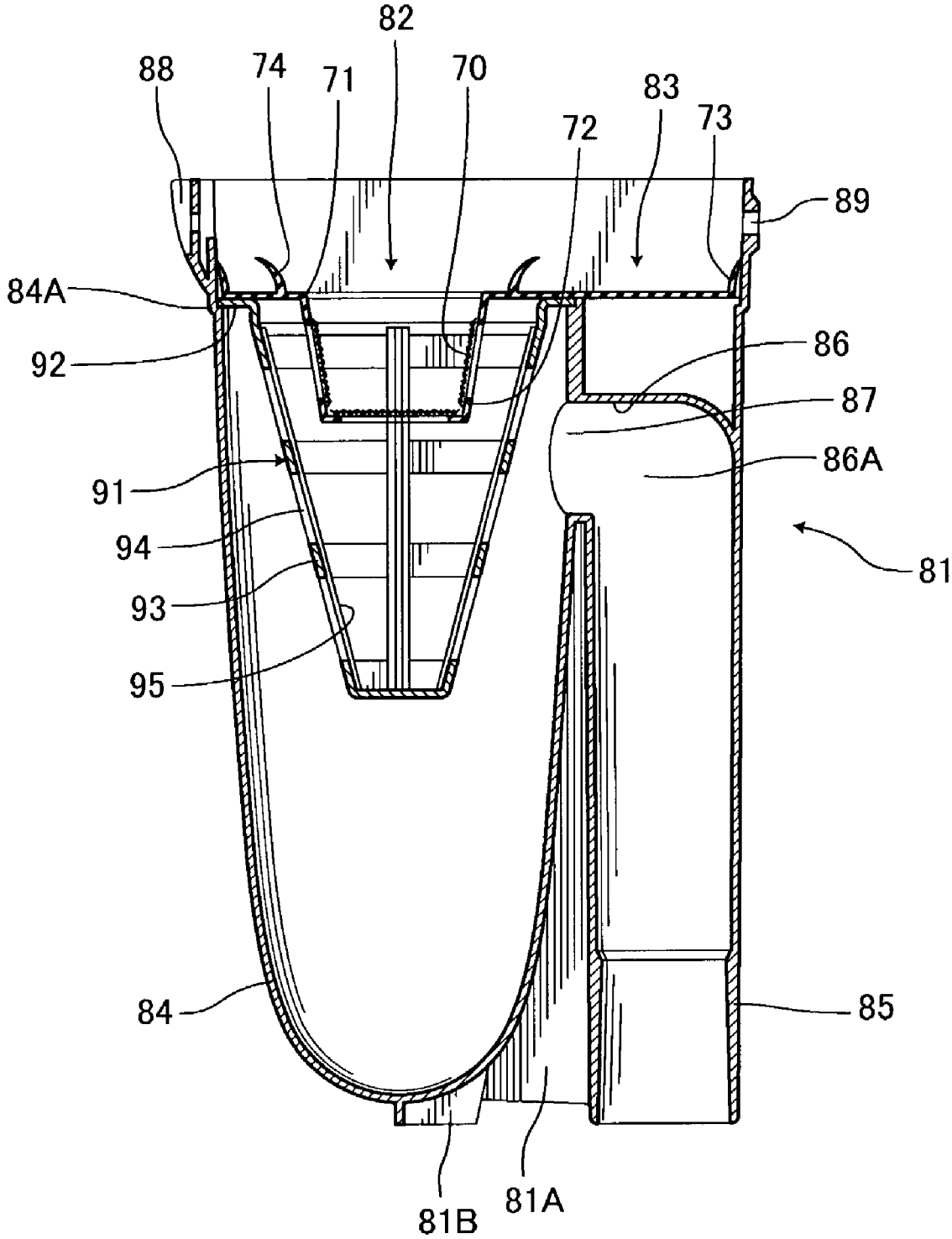
FIG. 12 is a cross-sectional view of a dust-collecting portion of a cyclonic vacuum cleaner according to a third embodiment of the present invention.
Figure 13:
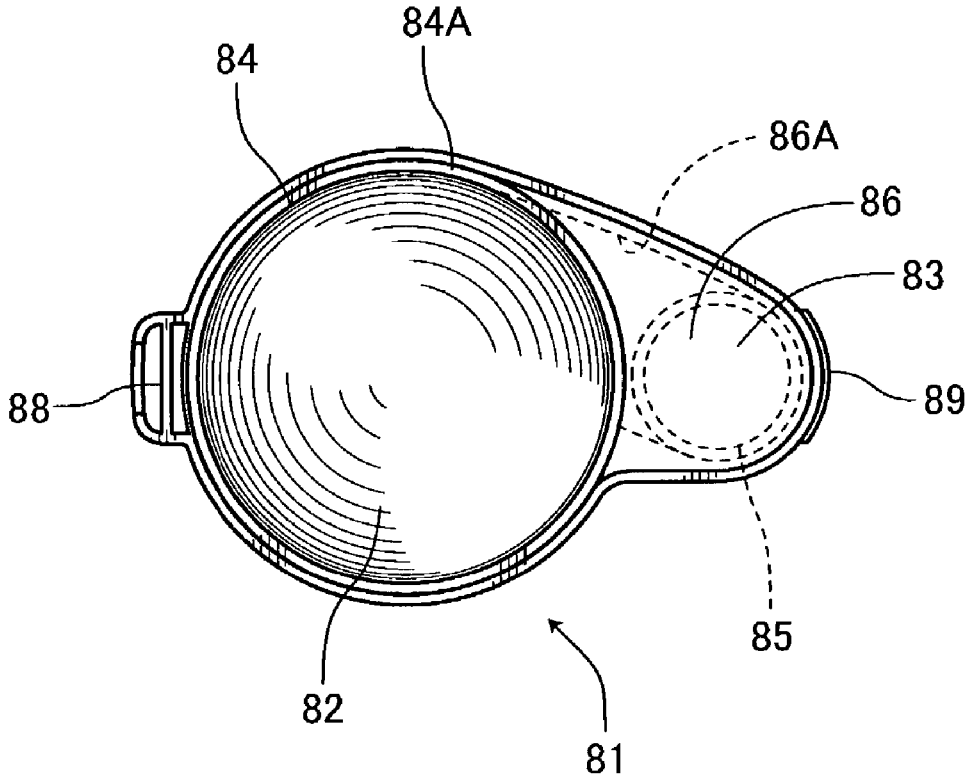
FIG. 13 is a plan view of the dust-collecting portion of the cyclonic vacuum cleaner of FIG. 12.
Figure 14:
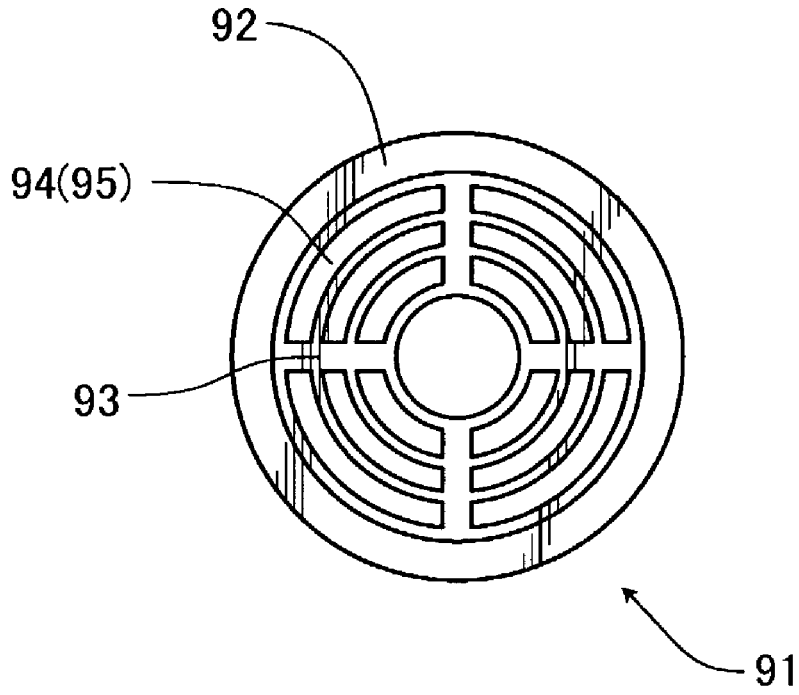
FIG. 14 is a bottom view of a conical portion of the cyclonic vacuum cleaner of FIG. 12.

Next is a description of a third embodiment of the present invention based on FIG. 12 to FIG. 14, in which the same reference symbols are used for the same parts as those described in the foregoing embodiments, and the repeated detailed description thereof is omitted.

A dust-collecting portion 81 made of resin is detachably attached to a lower portion of the cleaner body 1. The dust-collecting portion 81 is formed at its upper end with a first opening 82 for inserting the aforesaid guide portion 5 thereinto and a second opening 83 for inserting the convex portion 9 thereinto. Below the first opening 82 is formed a cyclonic portion 84 which is of an approximately cylindrical shape, being tapered toward a lower end having a bottom, while below the second opening 83 is formed an introducing portion 85 which has an cylindrical inside surface, extending substantially in parallel with an axial direction of the cyclonic portion 84. These cyclonic portion 84 and the introducing portion 85 are formed integrally from a common member.

As an introducing wall 86 serving as a vortex flow generating means is formed integrally with the dust-collecting portion 81 between the introducing portion 85 and the second opening 83, the upper end of the introducing portion 85 is closed while an introducing opening 87 is formed on a sidewall between an upper portion of the cyclonic portion 84 and the vicinity of the upper end of the introducing portion 85. Accordingly, a path from the lower end of the introducing portion 85 to the cyclonic portion 84 through the introducing opening 87 is formed integrally from a common material.

In the meantime, the introducing wall 86 is formed so as to define a smoothly curved surface in order to smoothly turn the direction of airflow ascending through the introducing portion 85 perpendicularly to the axis of the introducing portion 85 to thereby introduce the airflow from the introducing opening 87 into the cyclonic portion 84. The introducing opening 87 is so constructed that it may be open to the tangential direction of one side of the sidewall in the cyclonic portion 84. More specifically, an introducing sidewall 86A, i.e., a side face of the introducing wall 86 is constructed so that the introducing portion 85 may be connected substantially linearly with the tangential direction of the one side of the cyclonic portion 84. Accordingly, the airflow ascending through the introducing portion 85 is urged toward the tangential direction of the one side of the sidewall in the cyclonic portion 84.

Further, a conical portion 91 is detachably mounted to the first opening 82. The conical portion 91 comprises: a flange portion 92 mounted on a step portion 84A between the first opening 82 and the cyclonic portion 84; a conical base portion 93 formed integrally with the flange portion 92; a ventilating hole 94 provided on a side face of the base portion 93; and a filter 95 provided in the ventilating hole 94. The filter member 71 including the pouched filter 70 is provided on an upper portion of the conical portion 91. The filter member 71 has the frame 72 formed from flexible resin or rubber while the seal portion 73 formed around an outer periphery of the frame 72 is so constructed that it may closely contact the inner peripheries of the first opening 82 and the second opening 83. Further, the lip portion 74 is formed on a top portion of the frame 72 and is so constructed that it may be able to closely contact the lower end 5A of the guiding portion 5 in a manner that the lip portion 74 surrounds the intake hole 6, when the dust-collecting portion 81 equipped with the conical portion 91 and the filter member 71 is attached to the cleaner body 1.

Furthermore, a first receiving portion 88 which engages with the movable hook 8 is formed on a front side of the first opening 82 while a second receiving portion 89 which engages with the fixed hook 10 is formed on a rear side of the second opening 83. In the meantime, reference symbol 81A denotes a rib provided for enhancing the stiffness of the dust-collecting portion 81, said rib 81A being integrally formed between the cyclonic portion 84 and the introducing portion 85 so that these two portions are linked to each other. Reference numeral 81B designates a leg which is provided adjacent to the rib 81A and in the vicinity of a lower end of the cyclonic portion 84, said leg 81B being integral with the dust-collecting portion 81. The leg 81B has a lower end formed flush with that of the introducing portion 85 so that the dust-collecting portion 81 is able to stand by itself when the dust-collecting portion 81 is detached from the cleaner body 1. It should be noted that the structure of the dust-collecting portion 81 is simplified thus way. Incidentally, the nozzle 20 serving as a sucking nozzle is attached to a lower end of the introducing portion 85.

Next is a description of the behaviors of a cyclonic vacuum cleaner according to the present embodiment. In the first place, users attach the conical portion 91 to the first opening 82 while the filter member 71 to the first opening 82 and the second opening 83 of the dust-collecting portion 81. At that moment, the seal member 73 of the filter member 71 contacts closely the inner walls of the first opening 82 and the second opening 83. Then, after allowing the second receiving portion 89 of the dust-collecting portion 81 to engage with the fixed hook 10, the first receiving portion 88 is allowed to engage with the movable hook 8, so that the dust-collecting portion 81 is attached to the cleaner body 1. At that moment, the guide portion 5 is inserted into the first opening 82 and the convex portion 9 is also inserted into the second opening 83, so that the dust-collecting portion 81 is properly positioned relative to the cleaner body l. Further, the lip portion 74 of the filter member 71 contacts closely the lower end 5A of the guide portion 5 in a manner that surrounds the intake hole 6. Accordingly, a path from the inside of the cyclonic portion 84 to the intake hole 6 is sealed. Then, the nozzle 20 is attached to the lower end of the introducing portion 85.

Then, the power cord 38 is detached from the hooks 36, 37 so that it is connected to a power receptacle (not shown), operating the power switch-operating portion 39, so that the motor fan unit 4 is actuated. Then, dust-laden airflow is sucked from the nozzle 20 by the actuation of the motor fan unit 4. The airflow is sucked from the nozzle 20 to rise within the introducing portion 85, changing its flowing direction so as to flow along the introducing wall 86 at an upper end of the introducing portion 85, so that the airflow is introduced from the introducing opening 87 into the cyclonic portion 84 while flowing along the direction tangential to the one side of the sidewall of the cyclonic portion 84. At that moment, a path from a lower end of the introducing portion 85 to the cyclonic portion 84 via the introducing portion 85 and the introducing opening 87 is formed integrally from a common member, and thus there is very little possibility that the leakage of airflow may take place in this zone.

The airflow thus introduced into the cyclonic portion 84 is allowed to flow along the inner peripheral surface of the cyclonic portion 84 so that it is converted into a vortex flow and then it descends spirally. At that moment, dusts contained in the vortex flow are pressed to an inner peripheral surface of the cyclonic portion 84 by centrifugal force. Then, when the vortex flow reaches a bottom of the cyclonic portion 84, the vortex flow having been descending on the side of the inner peripheral surface of the cyclonic portion 84 in turn starts rising in the vicinity of the center of the cyclonic portion 84. At that moment, as the dusts contained in the vortex flow are pressed to the inner peripheral surface of the cyclonic portion 84 by centrifugal force as described above, comparatively rough dusts are allowed to stay in the vicinity of the inner peripheral surface of the cyclonic portion 84 so that they are separated from the vortex flow, even if the vortex flow flows toward the vicinity of the center of the cyclonic portion 84 from the side of the inner peripheral surface thereof.

On the other hand, comparatively fine dusts, which are being mixed in the vortex flow, are moved to the vicinity of the center of the cyclonic portion 84 and start to ascend in the cyclonic portion 84 in association with the rising of the vortex flow. Then, the ascended vortex flows pass through the ventilating hole 94 formed on a side surface of the conical portion 91 positioned at the upper portion. At that moment, comparatively fine dusts contained in the vortex flow are captured by the filter 95 attached to the ventilating hole 94, while still finer dusts having passed through the filter 95 are captured by the filter 70 of the filter member 71 provided on an upper portion of the conical portion 91. Airflow which has passed through the filter 95 of the conical portion 91 and the filter 70 of the filter member 71 reaches the motor fan unit 4 through the intake hole 6 to eventually go out of the cleaner body 1.

After cleaning, the nozzle 20 is detached from a lower end of the introducing portion 85 and then the dust-collecting portion 81 is detached from the cleaner body 1 by operating the movable hook 8. Then, the filter member 71 and the conical portion 91 are detached from the first opening 82 and the second opening 83, thus removing dusts adherent to the filters 95, 70. The dusts collected in the cyclonic portion 84 are dumped into a trash box. At this moment, as the cyclonic portion 84 is integrally formed with the introducing portion 85 in the dust-collecting portion 81, not only can the dusts within the cyclonic portion 84 be easily dumped but also can those collected in the introducing portion 85 be easily removed with the light dust-collecting portion 81 being held by a hand. Accordingly, even if sheet-like matter or the like is sucked so that the introducing portion 85 or introducing opening 87 is clogged therewith during cleaning, yet it can be easily removed.

Further, as the dust-collecting portion 81 is made of resin and is formed into one piece structure, it can be washed with water, so that the cyclonic portion 84 and the introducing portion 85 can be kept cleaner through such wet-cleaning. Still further, due to the leg 81B provided in the vicinity of the lower end of the cyclonic portion 84 and the lower end of the introducing portion 85, the dust-collecting portion 81 is allowed to be able to stand by itself with the first opening 82 and the second opening 83 facing upward. Hence, the dust-collecting portion 81 can be temporarily put on a flat place without littering the dusts, in the case of dumping dusts or in the like cases, and thus it is convenient to users.

As described above, a cyclonic vacuum cleaner according to the present embodiment comprises the cleaner body 1 with the motor fan unit 4 and the dust-collecting portion 81 detachably attached to the cleaner body 1, wherein the dust-collecting portion 81 comprises the cyclonic portion 84 which is approximately cylinder-shaped, having a bottom; the introducing portion 85 for introducing dust-laden airflow into the cyclonic portion 84, said introducing portion 85 being formed integrally with said cyclonic portion 84; the introducing wall 86 provided as a vortex flow generating member in the dust-collecting portion 81; and the nozzle 20 serving as a sucking nozzle, said nozzle 20 being detachably attached to the introducing portion 85.

Hence, airflow sucked from the nozzle 20 passes through the introducing portion 85 of the dust-collecting portion 81 to thereby be introduced into the cyclonic portion 84 formed integrally with the introducing portion 85, so that it is converted into a vortex flow within the cyclonic portion 84 by the introducing wall 86, whereby dusts are separated therefrom by centrifugal force and then the airflow passes through the motor fan unit 4 to be discharged to the outside of the cleaner body 1.

The dusts collected in the cyclonic portion 84 are dumped by detaching the dust-collecting portion 81 together with the introducing portion 85. Accordingly, not only can the structure of the cleaner body 1 be simplified despite the fact that a cyclonic vacuum cleaner tends to become too complex in structure, but the maintenance of the introducing portion 85 as well as that of the cyclonic portion 84 can be easily performed since dusts collected in the cyclonic portion 84 can be dumped through the detachment of the dust-collecting portion 81 together with the introducing portion 85. Further, as the structure from the introducing portion 85 to the cyclonic portion 84 is simplified thus way and therefore the number of components can be decreased, it is possible to reduce the manufacturing costs. Also, as there is no joint between the introducing portion 85 and the cyclonic portion 84, it is possible to diminish the number of joints in the whole cyclonic vacuum cleaner, and thus it is possible to reduce the possibility of airflow leakage that might take place in a suction passage, thereby enabling the enhancement of the dust-collecting performance.

Furthermore, as the introducing wall 86 serving as a vortex flow generating member is formed integrally with the dust-collecting portion 81, it is possible to further reduce the possibility of airflow leakage, thereby enabling the enhancement of dust collecting performance.

Moreover, the cyclonic vacuum cleaner of the embodiment includes: the first opening 82 and the second opening 83 formed in one end where the dust-collecting portion 81 is attached to the cleaner body 1; the introducing wall 86 provided on the one end side; the introducing portion 85 which is formed cylindrical; and the introducing opening 87 provided on the one end side for communicating the introducing portion 85 with the cyclonic portion 84, said introducing opening 87 being formed so as to be open in a crosswise direction relative to the axis of the introducing portion 85, whereby it is possible to further reduce the possibility of airflow leakage from the introducing portion 85 to the cyclonic portion 84, thereby enabling the enhancement of dust collecting performance still further.

Still also, as the introducing opening 87 is so constructed that it may be open to the tangential direction relative to the sidewall of the cyclonic portion 84, it is possible to efficiently generate the vortex flow within the cyclonic portion 84. Still also, as the one end of the introducing portion 85 is closed in its axial direction, while the introducing wall 86 for introducing the airflow from the introducing portion 85 into the introducing opening 87 is provided, said introducing wall 86 being formed so as to define a smoothly curved surface, the airflow from the introducing portion 85 can be introduced smoothly into the introducing opening 87 by the introducing wall 86.

Furthermore, a cyclonic vacuum cleaner of the embodiment is advantageous in that as the rib 81A for linking the cyclonic portion 84 with the introducing portion 85 is formed integrally therebetween, the dust-collecting portion 81 is allowed to have an enhanced stiffness, thus enabling the preventing of the damages to the dust-collecting portion 81.

In addition to the foregoing, as the leg 81B is provided integrally with the dust-collecting portion 81 in the vicinity of the lower end of the cyclonic portion 84, in such a manner that the lower end of the leg 81B is flush with that of the introducing portion 85, the dust-collecting portion 81 is allowed to be able to stand by itself on a flat place when the dust-collecting portion 81 is detached from the cleaner body 1.

The present invention should not be limited to the foregoing embodiments but various modifications are possible within the scope of the invention. For example, whilst the sucking nozzle is attached directly to the front edge of the introducing portion in each of the foregoing embodiments, the sucking nozzle may be attached indirectly thereto with a separate pipe such as an extension tube intervened between the introducing portion and the sucking nozzle. In that case, maintainability is improved although possibility of airflow leakage is increased. Further, whilst the dust-collecting portion is so constructed that the cyclonic portion and the introducing portion are formed integrally from a common member in each of the foregoing embodiments, the cyclonic portion and the introducing portion may be separately provided so that they are joined together air-tightly by welding, bonding or the like. Likewise, the introducing wall may be formed by joining the same to the dust-collecting portion by welding, adhesion or the like.

What is claimed is:

1. A cyclonic vacuum cleaner comprising a cleaner body with a fan motor and a dust-collecting portion detachable attached to the cleaner body, wherein said dust-collecting portion comprises:

a cyclonic portion which is approximately cylinder-shaped, having a bottom;

an introducing portion for introducing dust-laden airflow into said cyclonic portion, said introducing portion being formed integrally with said cyclonic portion;

a vortex flow generating means provided in said dust-collecting portion; and a suction nozzle detachably attached to said introducing portion, said suction nozzle being separate from said cleaner body;

wherein said dust-collecting portion is made up of a one-piece component composed of the cyclonic portion and the introducing portion integrally formed therewith.

2. A cyclonic vacuum cleaner according to claim 1, wherein said vortex flow generating means is detachably provided in said dust-collecting portion.

3. A cyclonic vacuum cleaner according to claim 2, further comprising:

an opening formed in one end where said dust-collecting portion is attached to said cleaner body; and an introducing opening provided on the one end side for communicating said introducing portion with said cyclonic portion, said introducing opening being fanned so as to be open in a crosswise direction relative to an axis of said introducing portion, wherein said vortex flow generating member is provided on the one end side while said introducing portion is formed cylindrical.

4. A cyclonic vacuum cleaner according to claim 2, wherein a skirt portion is provided in a lower portion of said vortex flow generating means.

5. A cyclonic vacuum cleaner according to claim 1, wherein said vortex flow generating means is formed integrally with said dust-collecting portion.

6. A cyclonic vacuum cleaner according to claim 5, further comprising:

an opening formed in one end where said dust-collecting portion is attached to said cleaner body; and an introducing opening provided on the one end side for communicating said introducing portion with said cyclonic portion, said introducing opening being formed so as to be open in a crosswise direction relative to an axis of said introducing portion, wherein said vortex flow generating member is provided on the one end side while said introducing portion is formed cylindrical.

7. A cyclonic vacuum cleaner according to claim 1, further comprising:

an opening formed in one end where said dust-collecting portion is attached to said cleaner body; and an introducing opening provided on the one end side for communicating said introducing portion with said cyclonic portion, said introducing opening being formed so as to be open in a crosswise direction relative to an axis of said introducing portion, wherein said vortex flow generating member is provided on the one end side while said introducing portion is formed cylindrical.

8. A cyclonic vacuum cleaner according to claim 7, wherein said introducing opening is so constructed that it may be open to a tangential direction of sidewall of said cyclonic portion.

9. A cyclonic vacuum cleaner according to claim 8, further comprising an introducing wall for introducing the airflow from said introducing portion into said introducing opening, said introducing wall being formed so as to define a smoothly curved surface, wherein one end of said introducing portion is closed in an axial direction thereof.

10. A cyclonic vacuum cleaner according to claim 7, further comprising an introducing wall for introducing the airflow from said introducing portion into said introducing opening, said introducing wall being formed so as to define a smoothly curved surface, wherein one end of said introducing portion is closed in an axial direction thereof.

11. A cyclonic vacuum cleaner according to claim 1, wherein a skirt portion is provided in a lower portion of said vortex flow generating means.

12. A cyclonic vacuum cleaner according to claim 1, wherein said introducing portion is formed in substantially parallel to an axial direction of said cyclonic portion, while said cleaner body is detachably attached to upper openings of said dust-collecting portion, and said suction nozzle is also detachably attached to a lower end of said introducing portion, said suction nozzle being separate from said cleaner body.

* * * * *